US005458495A

United States Patent [19]

Stone

[11] Patent Number: 5,458,495

[45] Date of Patent: Oct. 17, 1995

[54] BUILDING BLOCK HAVING OPPOSING MALE AND FEMALE HINGE ELEMENTS FOR CONNECTION TO LIKE ELEMENTS ON ANOTHER LIKE BLOCK

[75] Inventor: Robert J. Stone, Swavesey, United Kingdom

[73] Assignee: Nottingham Group Ltd., Nottingham, United Kingdom

[21] Appl. No.: 343,791

[22] Filed: Nov. 22, 1994

Related U.S. Application Data

[63] Continuation of Ser. No. 171,324, Dec. 21, 1993, abandoned, which is a continuation of Ser. No. 915,986, Jun. 16, 1992, abandoned.

[30] Foreign Application Priority Data

Dec. 18, 1989 [GB] United Kingdom ..... 8928504

[51] Int. Cl.[6] ..... G09B 25/00

[52] U.S. Cl. ..... 434/403; 446/125; 446/104

[58] Field of Search ..... 434/211, 215, 434/212, 403, 187; 446/120, 121, 125, 104

[56] References Cited

U.S. PATENT DOCUMENTS

| | | | |
|---|---|---|---|
| 137,075 | 3/1873 | Harrington | 434/211 X |
| 3,374,917 | 3/1968 | Troy | 446/125 X |
| 3,662,486 | 5/1972 | Freedman | 446/120 |
| 3,774,339 | 11/1973 | Swett | 446/121 |
| 4,195,437 | 4/1980 | Ace | 446/104 |
| 4,606,732 | 8/1986 | Lyman | 446/104 X |
| 4,731,041 | 3/1988 | Ziegler | 446/104 X |
| 4,886,477 | 12/1989 | Ziegler | 446/104 |
| 4,902,259 | 2/1990 | Ziegler | 446/117 |

FOREIGN PATENT DOCUMENTS 5342886 9/1986 Australia .

*Primary Examiner*—Gene Mancene
*Assistant Examiner*—Jeffery A. Smith
*Attorney, Agent, or Firm*—Deborah S. Ruff; Richard A. Speer

[57] ABSTRACT

This invention relates to a building block in the shape of a right-angles isosceles triangular prism. the block has male hinge elements on one edge and female hinge elements on another edge such that two blocks can not only be hingedly attached but also joined at both respective hinge; element carrying edges to form a cube. Male and female face connection elements are provided to allow face to face connection.

13 Claims, 3 Drawing Sheets

Fig. 1
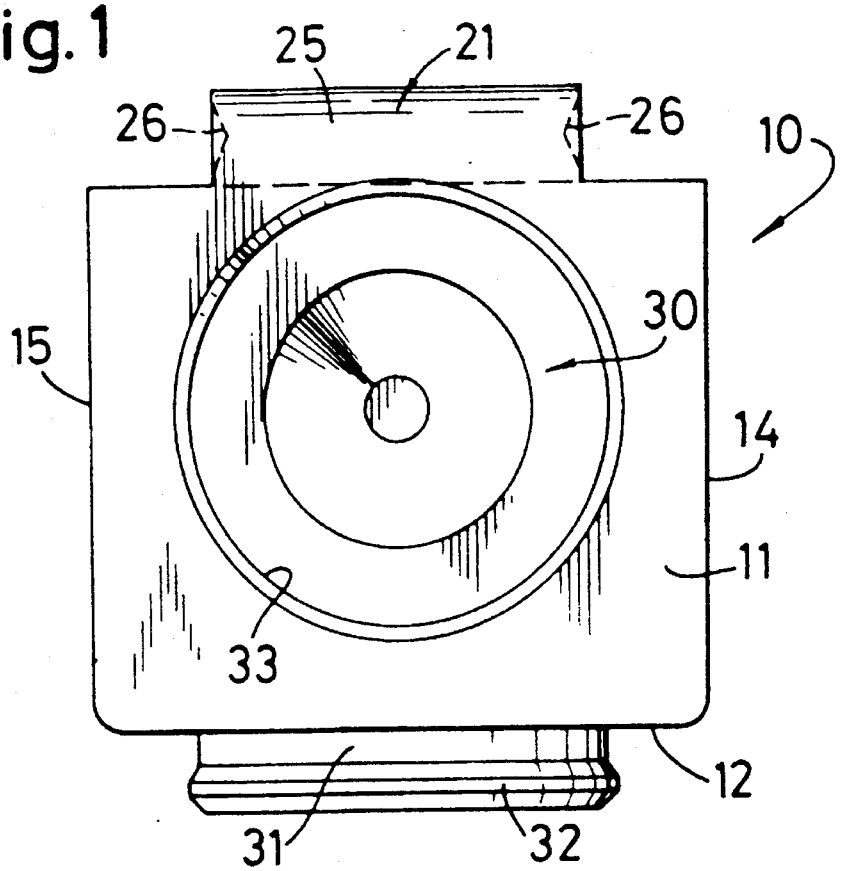
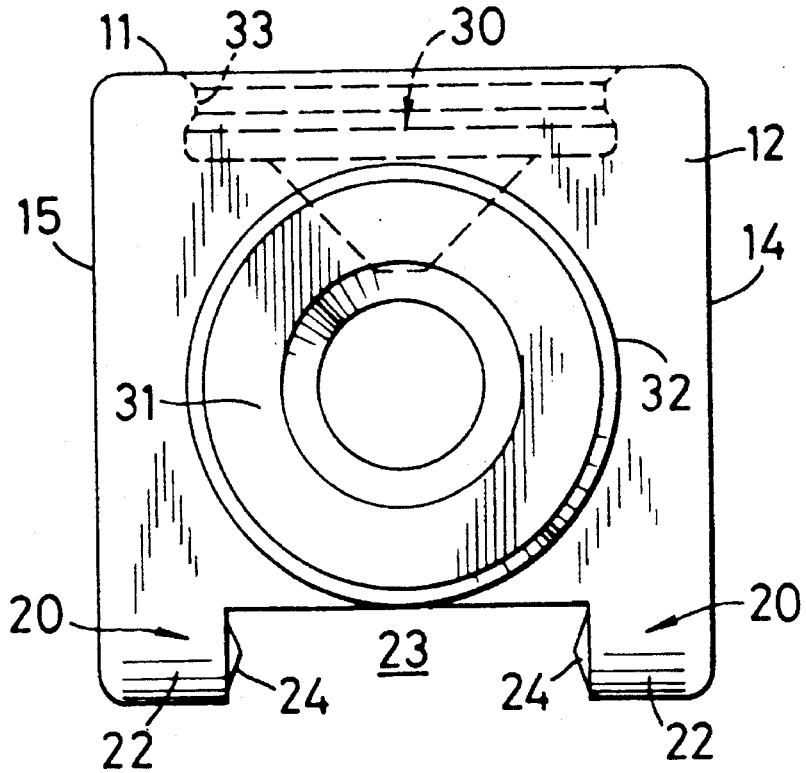
Fig. 2

BUILDING BLOCK HAVING OPPOSING MALE AND FEMALE HINGE ELEMENTS FOR CONNECTION TO LIKE ELEMENTS ON ANOTHER LIKE BLOCK

This is a continuation of application Ser. No. 08/171,324 filed on Dec. 21, 1993 (abandoned), which is a continuation of Ser. No. 07/915,986 filed on Jun. 16, 1992 (abandoned), the text of which is hereby incorporated by reference.

BACKGROUND OF THE INVENTION

This invention relates to building blocks. More particularly but not exclusively, it relates to an educational toy to teach different aspects of mathematics to children of all ages.

According to the present invention, there is provided a multi-faced building block adapted for assembly to produce a plurality of shapes by connecting a number of said building blocks, said block including male hinge means at a first edge of a face of said block and characterised by female hinge means at a second edge of said face opposite and parallel with said first edge, whereby two said blocks can be joined hingedly by connecting the male hinge means of one block to the female hinge means of the other block, and whereby two said blocks can be joined fixedly in face to face relation by connecting both the male and female hinge means of one block to the female and male hinge means, respectively, of the other block.

The building block may be in the shape of a triangular prism, preferably an isosceles triangular prism and, more preferably a right-angled isosceles triangular prism. The prism preferably has square faces lying between the short sides of the triangular faces.

The male and female hinge means may be located on the edges of the face which joins the hypotenuse of the right-angled triangle faces, whereby two substantially identical building blocks can be joined fixedly to form a cube.

The male and female hinge means may be located on the edges which define the ends of the hypotenuse. Preferably, the hinge axis lie parallel to the edges which define the ends of the hypotenuse.

The male hinge means may comprise a pair of oppositely extending protrusions and the female hinge means may comprise a pair of oppositely extending recesses adapted to be engaged by the protrusions with a snap fit. The protrusions may extend towards one another and the recesses may open away from one another.

Other independent features reside in the provision of a building block adapted for assembly to produce a plurality of shapes by connecting a number of said building blocks, each of said building blocks comprising a right-angled isosceles triangular prism, wherein said block has male hinge means at an edge defining one end of the hypotenuse, and female hinge means at an edge defining the other end of the hypotenuse, whereby two blocks can be hingedly joined together by connecting the male hinge means of one block to the female hinge means of the other block, and two of said blocks can be fixedly joined together using both pairs of hinge means to form a cube.

The building block may have a female face connection means on one face defining one of the equal sides of the isosceles triangle, and a male face connection means on the other face defining the other of the equal sides of the isosceles triangle.

The hinge axes preferably lie parallel to the edges defining the hypotenuse.

DETAILED DESCRIPTION OF THE DRAWINGS

By way of example, one embodiment of a block according to the invention will now be described with reference to the accompanying drawings, in which:

FIG. 1 is a side view of a building block;

FIG. 2 is an underneath view of the block of FIG. 1;

Figure 3:
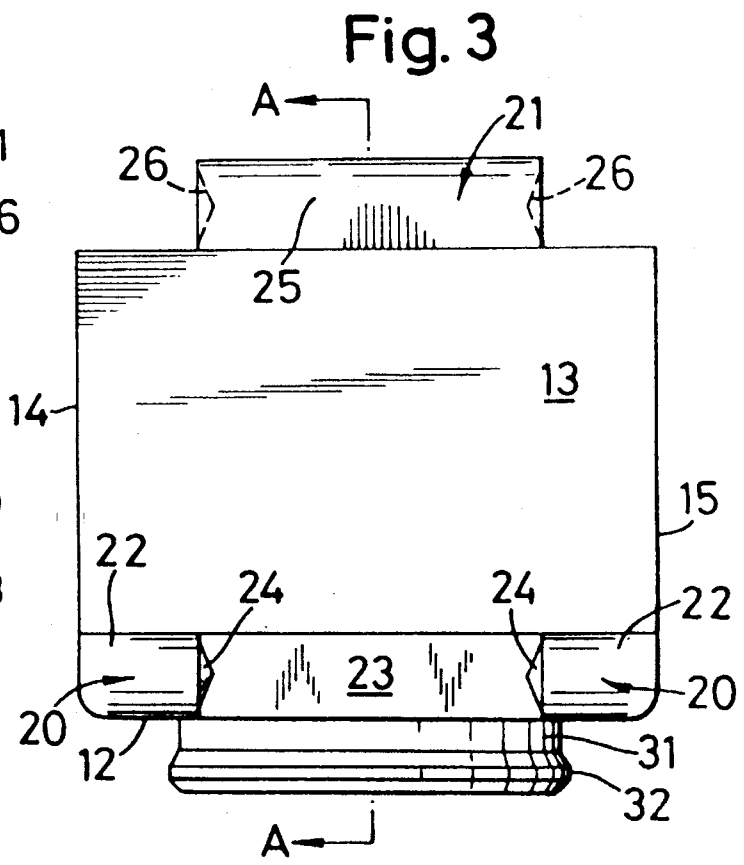
FIG. 3 is a face view of the block.
Figure 4:
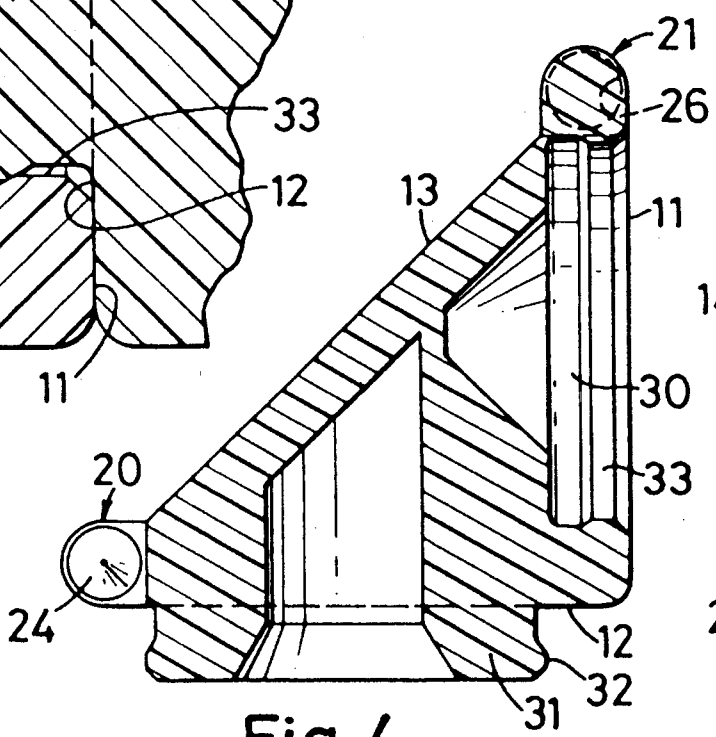
FIG. 4 is a sectional view along the lines A—A in FIG. 3.

A building block 10 of plastics material, although it will be appreciated that other materials could be used, is shaped generally in the form of a right-angled triangular prism. The building block has a pair of essentially square faces 11, 12 and a rectangular face 13 defining the hypotenuse of the right-angled triangle. The building block has two end faces 14, 15 which are, in their general shape, right-angled isosceles triangles.

The block 10 is provided with male hinge means 20 at one edge defining the hypotenuse of the right-angled triangular faces 14, 15 and female hinge means 21 at the other edge defining the hypotenuse of the triangular faces 14, 15. The male hinge means 20 consist of a pair of nibs 22 between which extends a space 23, conical protrusions 24 extending from the nibs 22 towards one another.

The female hinge means 21 consist of a rib 25 having conical recesses 26 in end faces thereof.

When the male hinge means 20 of one block and the female hinge means 21 of a second block are to be engaged together, the rib 25 of the second block is pushed into the space 23 of the first block and the conical protrusions 24 of the one block are engaged in the conical recesses 26 in the second block. In this way, a hinge connection is provided between the two blocks.

Figure 6:
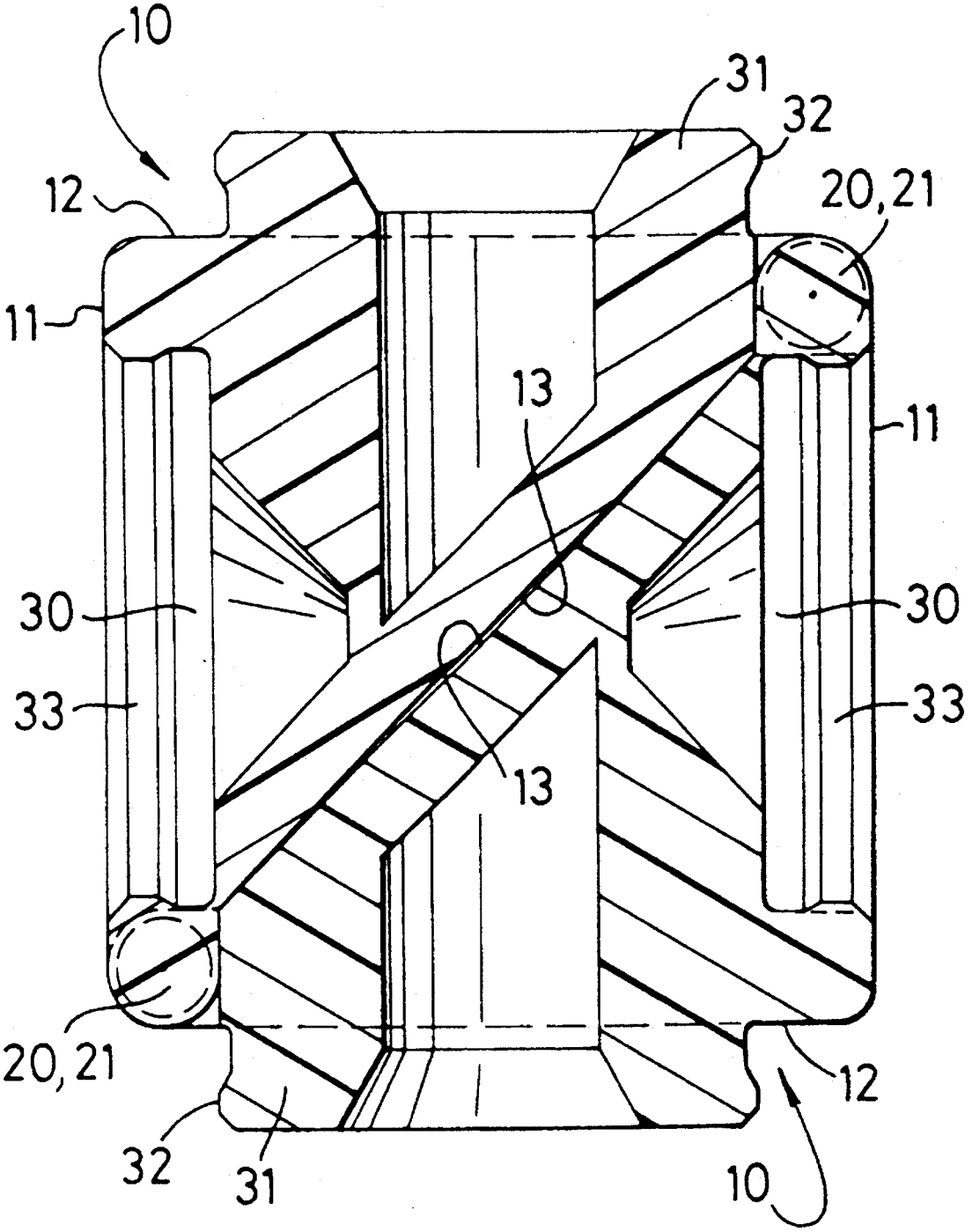
FIG. 6 is a sectional view illustrating a pair of blocks joined together by engagement of two pairs of hinge means.

Additionally, the shape of the blocks and positioning of the male and female hinge means 20, 21 is such that two such blocks 10 can be joined together by engagement of the male and female hinge means of one block with respective female and male hinge means of the second block to form a cube, as shown in FIG. 6. In the FIG. 6 arrangement, the respective rectangular faces 13 face towards one another, the faces 13 being very slightly recessed to ensure that there is no balking when the male and female hinge means are moved into engagement.

Figure 5:
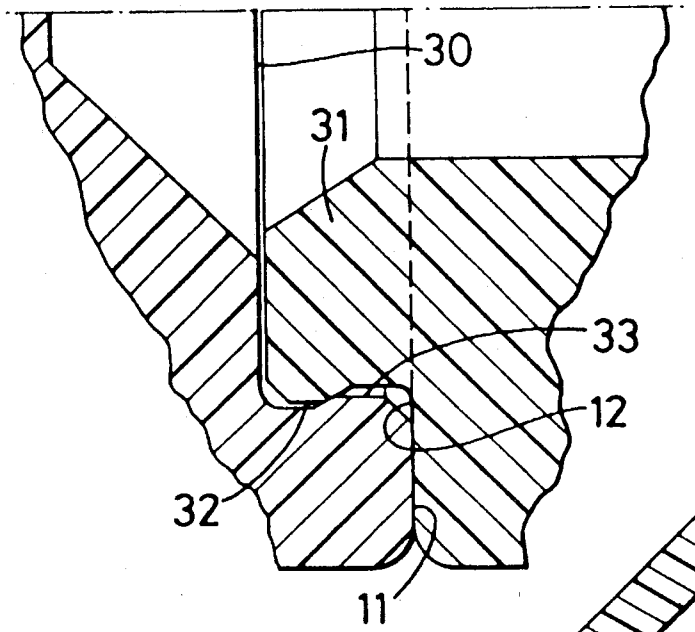
FIG. 5 is a view, on an enlarged scale, of a detail of a snap joint.

In addition to the hinge means, the block 10 is provided with face connection means, there being a socket 30 provided in the square face 11 and a spigot 31 extending from the square face 12 the spigot of one block 10 is engageable with the socket 30 of another block 10 with a snap fit, the engagement profiles of the spigot 31 and socket 30 being shown in more detail in FIG. 5. In FIG. 5, it can be seen that the spigot 31 is essentially cylindrical but with an annular engagement rim 32 near its free end. The socket 30 has an inwardly extending annular engagement rib 33 such that the annular rim 32 of the spigot 31 engages the annular rib 33 of the socket 30 with a snap fit. As is shown clearly in FIG. 5, both the annular rim 32 and annular rib 33 have chamfered profiles to allow ease of entry of the spigot into the socket and, furthermore, to allow relative ease of disengagement of the spigot from the socket since the blocks are designed to be engaged and disengaged relatively easily, but still allow sufficient strength of engagement to form a stable connection.

When two blocks are formed together in the FIG. 6 arrangement, a cube is formed having two planar faces, two faces having a spigot 31 extending therefrom and two faces including sockets 30. The FIG. 6 cube formed from two blocks 10 allows the blocks 10 to form part of a structure with existing cubes available under our Trade Mark MULTILINK, which cube have in their faces sockets with the same profile as the sockets 30 of the blocks 10 and spigots with the same profile as the spigots 31 of the blocks 10. In this way, the blocks 10 provide substantially increased flexibility and adaptability to the MULTILINK cubes in that the blocks 10 can be face-to-face connected with the existing cubes and, with two blocks 10 connected together at one hinge, a hinge connection is provided but alternatively with both hinge connections made, a cube is formed. It will be appreciated that a large variety of structures is thus possible.

It will be appreciated that the foregoing description is by way of example only and that modifications and alterations., may be made within the scope of the invention.

I claim:

1. A multi-faced building block adapted for interassembly to produce a plurality of shapes by connecting a number of like building blocks, said block including male hinge means at a first edge of a first face of said block and female hinge means at a second edge of said first face opposite and parallel with said first edge, whereby two said blocks can be joined hingedly by connecting the male hinge means of one block to the female hinge means of the other block, and whereby the arrangement of the male hinge means and the female hinge means relative to said first face of the block permits said one block to be joined fixedly in first face to first face relation to said other block having a like arrangement of male and female hinge means, by connecting both the male and female hinge means of said one block to the female and male hinge means, respectively, of said other block.

2. A building block as claimed in claim 1, wherein said building block is in the shape of a triangular prism.

3. A building block as claimed in claim 2, wherein said triangular prism is an isosceles triangular prism.

4. A building block as claimed in claim 3, wherein said isosceles triangular prism is a right-angled isosceles triangular prism.

5. A building block as claimed in claim 4, wherein said prism further has first and second right-angled isosceles triangular faces and first and second square faces lying between said first and second triangular faces.

6. A building block according to claim 5, wherein said first face joins the hypotenuses of the first and second triangular faces, whereby said two like building blocks can be joined fixedly to form a cube.

7. A building block according to claim 6, wherein said first edge of said first face is located at respective first ends of said hypotenuses and said second edge of said first face is located at respective second ends of said hypotenuses.

8. A building block according to claim 7, wherein the male and female hinge means lie parallel to at least one of said first edge of said first face and said second edge of said first face.

9. A building block according to claim 3, wherein said building block has a female face connection means on one face defining one of the equal sides of the isosceles triangle, and a male face connection means on the other face defining the other of the equal sides of the isosceles triangle.

10. A building block according to claim 1, wherein the male hinge means comprises a pair of oppositely extending protrusions.

11. A building block as claimed in claim 10, wherein said female hinge means comprises a pair of oppositely extending recesses adapted to be engaged by said protrusions with a snap fit.

12. A building block as claimed in claim 11, wherein said protrusions extend towards one another and the recesses open away from one another.

13. A building block adapted for interassembly to produce a plurality of shapes by connecting a number of like building blocks, said block comprising:

a member having a plurality of faces, one of said faces having a first edge and a second edge opposite and parallel to said first edge;

male hinge means on said first edge of said one face; and female hinge means on said second edge of said one face;

said building block being joinable hingedly to another said building block having a like arrangement of male and female hinge means by connecting said male hinge means on said building block to said female hinge means on said other building block, and said building block being joinable fixedly to said other building block in one face to one face relation by connecting both said male and said female hinge means of said building block to said female and said male hinge means, respectively, of said other building block.

* * * * *